US005931516A

United States Patent [19]

Holtman et al.

[11] Patent Number: 5,931,516

[45] Date of Patent: Aug. 3, 1999

[54] SWELL LATCH ASSEMBLY

[75] Inventors: Eli J. Holtman, Narberth, Pa.; Roger Phillip Wytcherley, Suckley, United Kingdom

[73] Assignee: Southco, Inc., Concordville, Pa.

[21] Appl. No.: 09/003,487

[22] Filed: Jan. 6, 1998

[51] Int. Cl.[6] ..... B65D 45/30

[52] U.S. Cl. ..... 292/257; 292/140; 411/525

[58] Field of Search ..... 292/1, 185, 140, 292/143, DIG. 16, 257; 411/34, 525, 526

[56] References Cited

U.S. PATENT DOCUMENTS

| | | | |
|---|---|---|---|
| 1,931,850 | 10/1933 | Moore | 292/113 |
| 2,094,779 | 10/1937 | Donaldson | 29/84 |
| 2,319,504 | 5/1943 | Holman | 292/1 |
| 2,691,543 | 10/1954 | Morand | 292/1 |
| 3,367,228 | 2/1968 | King | 85/7 |
| 3,429,199 | 2/1969 | Kenyon | 74/548 |
| 3,910,155 | 10/1975 | Wilson | 85/70 |
| 4,490,576 | 12/1984 | Bolante et al. | 174/65 SS |
| 4,540,206 | 9/1985 | Frame et al. | 292/66 |
| 4,729,584 | 3/1988 | Beckerer, Jr. | 292/257 |
| 4,906,148 | 3/1990 | Schule | 411/34 |
| 5,127,684 | 7/1992 | Klotz et al. | 292/113 |
| 5,184,698 | 2/1993 | Coffenberry | 184/1.5 |
| 5,368,347 | 11/1994 | Holtman et al. | 292/257 |
| 5,488,808 | 2/1996 | Cahill et al. | 52/584.1 |
| 5,590,921 | 1/1997 | Holtman et al. | 292/257 |
| 5,713,692 | 2/1998 | McCarrick et al. | 403/329 |

FOREIGN PATENT DOCUMENTS

480534 A1 4/1992 European Pat. Off. .

OTHER PUBLICATIONS

Southco Fasteners Handbook 40 (Southco Inc., Pennsylvania, 1990) Swell Latches, pp. J–2 and J–3.

Southco Fasteners Handbook 40 (Southco Inc., Pennsylvania, 1990) Fractional–Turn Fastener, p. J–12.

*Primary Examiner*—Steven Meyers
*Assistant Examiner*—John B. Walsh
*Attorney, Agent, or Firm*—Paul & Paul

[57] ABSTRACT

A latch assembly is mounted in an aperture formed in a first member for releaseably retaining the first member against a corresponding second member and in a latched position. The latch assembly includes a handle which is adapted for pivotal rotation, a shaft connected with the handle for movement corresponding with the pivotal rotation of the handle and a latching member on the shaft which is adapted to engage the second member in the latched position when the handle is pivoted to the closed position.

32 Claims, 3 Drawing Sheets

SWELL LATCH ASSEMBLY

BACKGROUND OF THE INVENTION

1. Field of the Invention

The present invention relates generally to latching devices and more particularly to swell latch assemblies.

2. Brief Description of the Prior Art

Swell latch assemblies are known to be operable for securing two panels or a panel against a corresponding frame. Generally, latches of this type are mounted proximate the edges of the first panel and on engagement are adapted to compress the first panel against the corresponding second panel or frame and into a latched position. Typically, a handle is provided pivotally connected by a pin to a shaft which is inserted through an aperture in the panel member. A rubber bushing is also provided mounted on the shaft and secured by a nut. In operation, the rubber bushing when unlatched can be passed through a hole formed in the corresponding panel or frame. On latching, pivotal movement of the handle from an open to a closed position corresponds with axial movement of the shaft. The axial movement of the shaft works to compress and deform or "swell" the rubber bushing so as to engage an inner surface of the corresponding panel member or frame and into a latched position.

Other examples of prior art swell latch assemblies are illustrated in U.S. Pat. No. 5,368,347 ('347 Patent) to Eli J. Holtman, Edward A. McCormack and Jarl Mork titled "Swell Latch Assembly", which is assigned to Southco, Inc., the assignee of the present application, the entire disclosure of which is hereby incorporated by reference. In the '347 Patent, several embodiments of swell latch assemblies are illustrated in which the shaft and handle are connected without requiring the use of a separate pin. In one specific embodiment, a swell latch assembly is shown in which the shaft is integrally formed to the handle providing a living hinge.

Certain specific drawbacks and deficiencies have been noted with such forgoing prior art swell latch assemblies. For example, in the swell latch assembly illustrated in the '347 Patent in which the shaft is connected by a living hinge to a handle, it has been observed that a load is placed directly upon the living hinge connection during operation of the latch, which can result with either damage or complete failure of the latch due to the weaker structure of the living hinge. In addition, another potential drawback observed in the various swell latch assemblies illustrated in the '347 Patent, as well as with other prior art swell latch assemblies incorporating a pin for connection of the handle to the shaft, is that the positions of the shaft relative to the handle are not regulated. For example, the position of the handle relative to the shaft is typically regulated by the spring force of the bushing member, which creates a tension upon the shaft that in turn securely positions the handle in engagement with a surface of the panel, or where a flush mounted latch is provided within a housing, in engagement with an inner surface of the housing. However, in some instances, the tension on the shaft may not be sufficient in order to retain the handle and shaft in their desired positions when either in a latched or unlatched position.

The present invention has been developed in view of the foregoing and to overcome the deficiencies of the prior art.

SUMMARY OF THE INVENTION

The present invention discloses a latch assembly for mounting in an aperture formed in a first member adapted for releaseably retaining the first member against a corresponding second member and in a latched position. The latch assembly comprises a handle member adapted for pivotal rotation between a closed position and an open position, a shaft connected to the handle member responsive to the pivotal movement of the handle member and a latching member on the shaft. In addition, the latch assembly may comprise either one or both of a support means between the shaft and the handle member for supporting the shaft against the handle member at least when the handle member is moved to its closed position and means between the shaft and the handle member for retaining the shaft in a defined position relative to the handle member.

In accordance with the present invention, an object is to provide a latch assembly such as a swell latch assembly having a handle connected to a shaft in which at least a portion of the tension on the shaft occurring during operation is transferred from the connection between the handle and the shaft to another portion of the latch.

It is another object of the present invention to provide a latch assembly having a handle connected to a shaft such as a swell latch assembly in which the position of the handle and the shaft can be regulated relative to each other.

Still another object of the present invention is to provide a swell latch assembly in which the parts are few and which provides for a simple installation process.

These and other objects of the present invention will become more readily apparent when taken into consideration with the following description and the attached drawings.

DETAILED DESCRIPTION OF THE PREFERRED EMBODIMENTS

Figure 1:
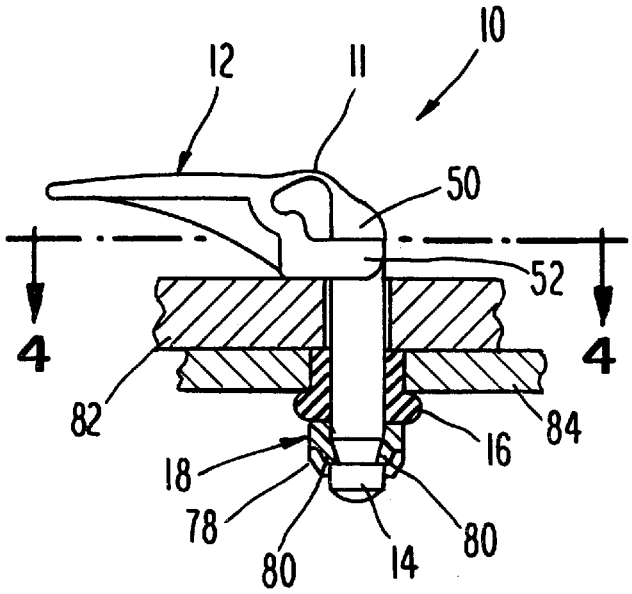
FIG. 1 is a right side elevational view, partly in section, showing an embodiment of a swell latch assembly in accordance with the present invention, the swell latch assembly shown in a latched position.

Referring now to the drawings in detail, wherein like reference numerals indicate like elements throughout the several views, there is shown in FIGS. 1–4 a swell latch assembly in accordance with an embodiment of the present invention. The swell latch assembly 10 as illustrated in FIG. 1 is in a latched position and mounted in an aperture formed through a section of a first member 82. The first member 82 as shown is in engagement with a section of a second member 84. The first member 82 according to the present invention can comprise a door, panel or the like which is adapted to engage the second member 84 in a closed position, which can comprise a corresponding door, panel or the like or a frame structure depending on the application of the swell latch assembly 10. The composition of the first and second members 82 and 84 can be of any suitable type of material, although material which will provide a rigid support structure is preferred, such as wood, plastic or sheet metal. As illustrated in the figures, the major components of the swell latch assembly 10 of the present invention are a handle member 12, a shaft 14, a latching member 16 and a retaining member 18. The handle member 12, as illustrated, is pivotally connected to the shaft 14. In the present embodiment, the handle 12 and shaft 14 are of one-piece in construction, with the shaft 14 being preferably formed in connection with and extending from the handle 12 by a hinge 11 providing a living hinge. Preferably, the integral handle 12/shaft 14 combination is manufactured by injection molding of conventional thermoplastic or thermosetting materials, such as polypropylene or nylon, although other suitable materials or manufacturing processes can also be used for the same purpose.

Figure 3:
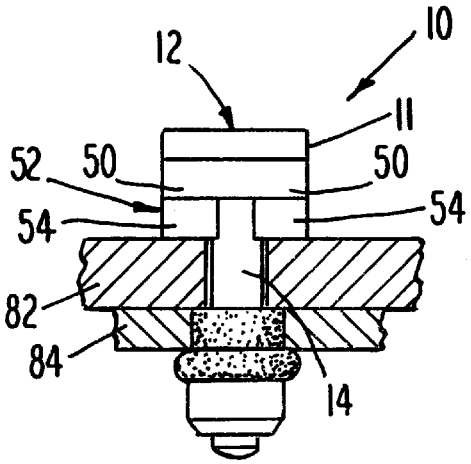
FIG. 3 is a front elevational view showing the swell latch assembly of FIG. 1.

In addition, in the present embodiment as best seen in FIG. 3, at least one and preferably two projections 50 extend from an outer surface of the shaft 14 between a distal end of the shaft 14 and the living hinge connection of the shaft 14 with the handle 12. In this embodiment, each projection 50 extending from the shaft 14 preferably extends a defined distance from the outer surface of the shaft 14 and extends a predetermined distance around the perimeter of the shaft 14. In a presently preferred embodiment, the two projections 50 shown in the figures extend from opposite sides of the shaft 14 defining in combination a generally rectangular shaped member, although it should be understood that any number of projections 50 and of any desired configuration can be provided for this same purpose. In this embodiment, the generally rectangular shaped member defined by the two projections 50 includes an upper surface attached with an upper surface of the handle member 12 via the hinge 11 and the terminating ends of the generally rectangular shaped member define a width of the same size as the width of the handle member 12.

Figure 4:
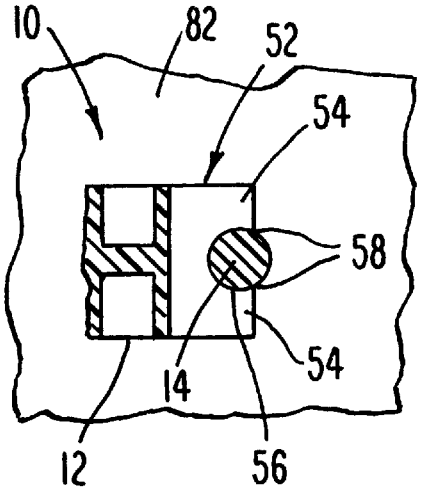
FIG. 4 is a top plan view partly in section of the swell latch assembly of FIG. 1 taken along the line 4—4.

The handle member 12 in the present embodiment includes a seating member 52 preferably proximate the living hinge connection of the handle 12 and shaft 14. In the present embodiment as best seen in FIGS. 3 and 4, the seating member 52 preferably comprises two bosses 54 at spaced separation having first ends attached to the handle 12 and distal ends generally radiused in configuration. In this embodiment, the two bosses 54 are provided with substantially radiused shaped inner surfaces 56, which together define the spaced separation between the two bosses 54 in the form of a substantially circular-shaped hole with a space of a defined diameter between the distal ends. In addition, the two bosses 54 each further preferably include in the present embodiment camming surfaces 58 positioned proximate the distal ends. In this embodiment, the camming surfaces 58 are a portion of the inner surfaces 56 positioned at the distal ends of the two bosses 54. As will be described in more detail herein, in the present embodiment, preferably the space between the camming surfaces 58 is sized having a defined gap that is smaller than a diameter of at least a portion of the shaft 14, which is the portion received into the space between the camming surfaces 58 in operation. As should be understood, the camming surfaces 58 can be provided of other configurations as well and positioned at different locations where desired.

The latching member 16 in the present embodiment comprises a bushing preferably of a suitable elastomeric material, such as rubber, although other suitable elastic materials can also be used. The bushing 16 in the present embodiment comprises a substantially cylindrical member having an opening extending therethrough along its longitudinal axis.

The retaining member 18 in the present embodiment can comprise a separate element or be provided as part of the shaft 14. In this embodiment, the retaining member 18 is provided as a separate element adapted for being snap-fit onto the shaft 14, although any conventional nut or similar member having any suitable means for attachment with the shaft 14 can also be used. An embodiment of the separate retaining member 18 is shown in FIGS. 1–3 and 8 comprising a generally cylindrical member defining an upper surface having an inwardly shaped cavity provided therein, a lower surface having a cavity therein terminating by substantially annular seating member 78 and a through hole extending the longitudinal axis of the retaining member 18 through each of the upper and lower surfaces. In addition, in this embodiment, the retaining member 18 includes at least one and preferably four substantially resilient tabs 80 (only two of which are visible) positioned within the through hole of the retaining member 18 attached to the seating member 78 and extending in a direction of the lower surface. In this embodiment, the four tabs 80 are equally spaced at approximately 90 degree intervals around the entire surface of the annular seating member 78 of the retaining member 18. The retaining member 18 in the present embodiment is preferably comprised of suitable thermoplastic or thermosetting materials, although any other suitable materials can also be utilized for the same purpose.

Figure 2:
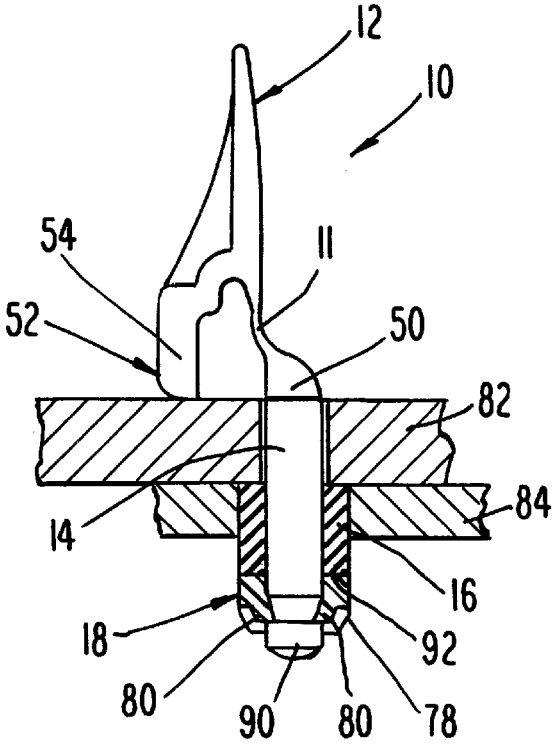
FIG. 2 is a right side elevational view, partly in section, showing the swell latch assembly of FIG. 1 in an unlatched position.

As discussed above, the retaining member 18 in the present embodiment is adapted for being snap-fit onto the shaft 14. For this purpose, as shown in FIG. 2, the distal end of the shaft 14 is provided having a captivation member defined by a substantially convex terminating surface 90 and an annular ring 92 at an upper surface adjacent to a inwardly ramped notch extending entirely around the shaft 14 in the present embodiment.

The installation of the swell latch assembly 10 will now be described in relation to the first and second members 82 and 84. On installation, the integral handle member 12/shaft 14 combination is inserted through the aperture in the first member 82, followed by the bushing 16 and retaining member 18 being mounted onto the shaft 14 from the inner side of the panel 82. Specifically, the bushing 16 is mounted onto the shaft 14 via the through hole extending within the bushing 16 and the retaining member 18 in the present embodiment is mounted by being snap-fit onto the shaft 14 by the engagement of the tabs 80 and the captivation member portion of the shaft 14. The snap-fit engagement between the retaining member 18 and shaft 14 is accomplished by the tabs 80 first being flexed in an outward direction toward the outer surface of the retaining member 18 due to contact with the convex lower surface 90 of the captivation member. Thereafter, as the retaining member 18 is moved further onto the shaft 12, the tabs 80 are moved past the captivation member allowing the tabs 80 to flex back toward their original position and into engagement with the outer surface of the shaft 14, which in the present embodiment is against the surface defined by the ramped notch extending around the shaft 14 and against the annular ring 92 at the upper surface of the captivation member. When the retaining member 18 is mounted onto the shaft 14, the bushing 16 is positioned between and preferably engaging both the retaining member 18 and inner surface of the first member 82. In this embodiment, the shaft 14 is of a predetermined length so that the bushing 16 is under a desired amount of compression when the retaining member 18 is mounted onto the shaft 14. In this embodiment, the mounting of the bushing 16 and retaining member 18 on the shaft 14 is most easily accomplished with the handle member 12 being oriented in its open position shown in FIG. 2, with the radiused distal ends of the two bosses 54 engaging the outer surface of the first member 82 and with the longitudinal axis of the handle member 12 positioned substantially perpendicular to the outer surface of the first member 82.

In operation, the first member 82 and the second member 84 are brought into contact with one another for closing of the two members. As shown in the figures, the second member 84 is provided with an aperture therethrough, in order to allow passage of the bushing 16 and retaining member 18, as the first and second members 82 and 84 are moved into a position in which preferably the inner surface of the first member 82 is brought into contact with the outer surface of the second member 84. From this position, the handle member 12 is pivotally rotated from its open to its closed position which corresponds with axial movement of the shaft 14 outwardly in the first direction toward the first member 82. In this embodiment, the pivotal rotation of the handle member 12 moves the radiused distal ends of the bosses 54 against the outer surface of the first member 82 in a direction of the shaft 12. The axial movement of the shaft 14 operates to provide corresponding axial movement of the retaining member 18, which works to compress and swell the bushing 16 captured between the first member 82 and retaining member 18. The swelled outer surface of the bushing 16 presses securely against the inner surface of the second member 84 and the lower surface of the seating member 52 comes into contact with the outer surface of the first member 82 in order to retain the first and second members 82 and 84 in the closed position.

As discussed earlier in this application, the latch assembly in accordance with the present invention may comprise either one or both of a support means between the shaft and the handle member for supporting the shaft against the handle member at least when the handle member is moved to its closed position and/or means between the shaft and the handle member for retaining the shaft in a defined position relative to the handle member at least when the handle is in the closed position. As will be described in more detail below, in the present embodiment, the combination of the shaft 14 and seating member 52 of the handle member 12 provide both of the foregoing two features of the present invention. Specifically, during operation of the latch, the rotation of the handle member 12 from the open to the closed position moves the seating member 52 into a position to engage a portion of the shaft 14. In particular, the camming surfaces 58 of the first and second bosses 54 initially come into contact with the shaft 14. As discussed earlier, the outer portion of the shaft 14 comes into contact with the portion of the inner surfaces 56 of the seating member 52 comprising the camming surfaces 58. In this embodiment, since the spacing between the camming surfaces 58 is sized less than a diameter of the portion of the shaft 14 received therein, a continued rotation of the handle member 12 toward the closed position forces the camming surfaces 58 to flex from an original position to an extended position away from the shaft 14. Thereafter, when the handle member 12 is rotated far enough toward the closed position, the camming surfaces 58 are moved past the shaft 14 and flex or "snap" back toward their original position. In this embodiment, when the handle member 12 is in its fully closed position, preferably the shaft 14 is positioned within the substantially circular-shaped hole between the inner surfaces 56 of the two bosses 54 as shown in FIG. 4.

As discussed above, rotation of the handle member 12 from the open to the closed position results with axial movement of the shaft 14 in the first direction toward the second member 84, which creates tension on the shaft 14 due to compression of the bushing 16 between the retaining member 18 and the inner surface of the second member 84. In the present embodiment, the engagement of the two projections 50 with an upper surface of the seating member 52 as the handle member 12 is rotated from its open to its closed position results with the handle member 12 providing support for the shaft 14 both as the shaft 14 is moved axially toward the second member 84 and when the swell latch assembly is in the latched position. In this matter, the tension on the shaft 14 occurring when the bushing 16 is compressed is substantially taken up by the handle member 12 rather than the living hinge connection between the shaft 14 and handle member 12.

Figure 5:
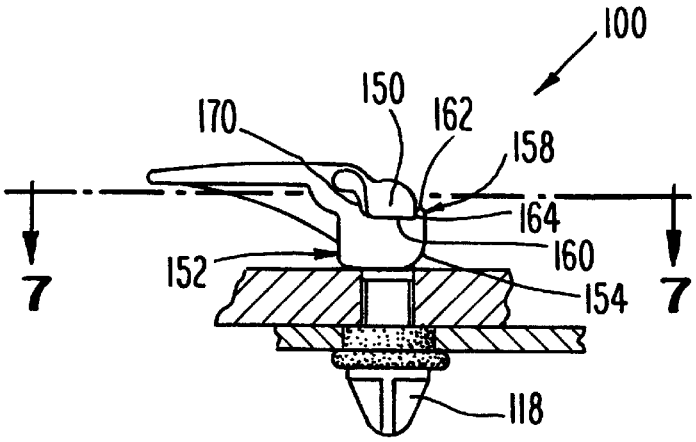
FIG. 5 is a right side elevational view of another embodiment of the swell latch assembly in accordance with the present invention, the swell latch assembly shown in a latched position.
Figure 6:
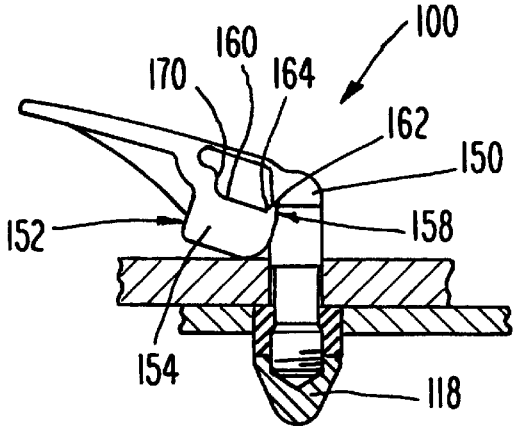
FIG. 6 is a right side elevational view, partly in section, of the swell latch assembly of FIG. 5, the swell latch assembly shown in a transition between latched and unlatched positions.
Figure 7:
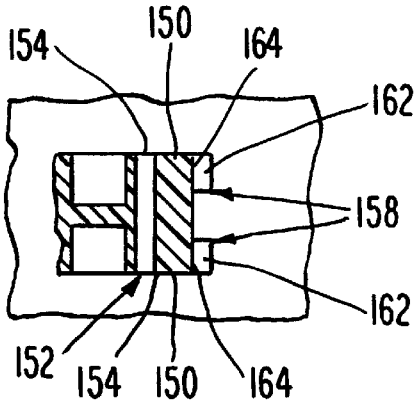
FIG. 7 is a top plan view partly in section of the swell latch assembly of FIG. 5 taken along the line 7—7.
Figure 8:
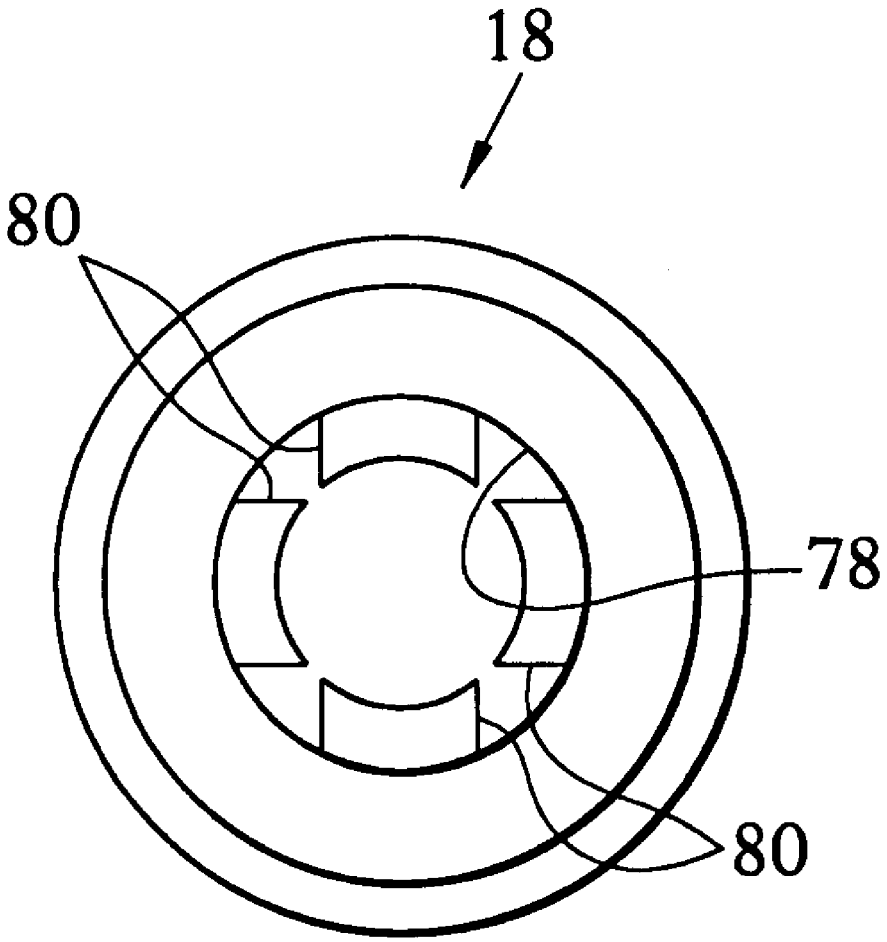
FIG. 8 is an isolated, slightly enlarged, top plan view of a retaining member of FIG. 1.

Another embodiment of the present invention is illustrated in FIGS. 5–7. The swell latch assembly 100 corresponds to the swell latch assembly 10 comprising the similar portions of a handle member, shaft, latching member comprising a bushing and a retaining member. The only portions which are different in the swell latch assembly 100 are the means between the shaft and the handle member for retaining the shaft in a defined position,which is defined by the interaction of the seating member and projections of the shaft, and the retaining member, and for sake of brevity, these particular portions will be the only portions described herein. In the present embodiment, the seating member 152 preferably included two camming surfaces 158 attached to an upper surface 160 of the two bosses 154 and extending outwardly therefrom, which is at substantially 90 degrees in the present embodiment. The camming surfaces 158 in this embodiment each preferably include a substantially ramped forward surface 162 and a locking surface 164 positioned substantially perpendicular to the upper surface 160 of the two bosses 154. The two substantially ramped forward surfaces 162 are preferably positioned closer than the locking surfaces 164 to the distal end of the bosses 154. In this embodiment, the locking surface 164, upper surfaces 160 of the bosses 154 and a connecting surface 170 of the handle, to which the bosses 154 are attached, define a generally U-shaped opening.

The retaining member 118 in this embodiment is provided as a separate element and having a threaded aperture which is received onto a threaded portion of the shaft, which is shown in FIG. 6.

In operation, the camming surfaces 158 and preferably the substantially ramped forward surfaces 162 initially engage a forward surface of the two projections 150 as the handle member is pivoted to its closed position, as is shown in FIG. 6. Following the initial contact of the camming surfaces 158 with the two projections 150, continued rotation of the handle member to the closed position causes the two projections 150 to ride up the substantially ramped forward surface 162, which results with increased compression of the bushing. Thereafter, continued rotation of the handle member into the closed position will move the two projections 150 past the substantially ramped forward surfaces 162 and into a defined position shown in FIGS. 5 and 7, which results with partial relaxing of the bushing. In the present embodiment, when the projections 150 are in the defined position, preferably at least the rear surfaces of the two projections 150 engage the locking surfaces 164, and the projections 150 are positioned within the substantially U-shaped opening of the seating member 152, with the lower surfaces of the two projections 150 engaging the upper surface 160 of the seating member 152. The engagement of the locking surfaces 164 of the camming surfaces 158 with the rear surfaces of the two projections 150 operate to retain the position of the shaft relative to the handle member. In addition, the compression of the bushing also works to retain the position of the shaft relative to the handle member by preferably maintaining the position of the projections 150 against the upper surfaces 160 of the seating member 152, or at least limiting the amount of displacement that the projections 150 can travel away from the upper surfaces 160, which can occur as a result of impact on the latch or panel; in particular, so that the projections 150 will not move back over the camming surfaces 158.

In view of that set forth above, it should be understood that there are several advantages of the latch assembly of the present invention over conventional latch assemblies. One advantage of the present invention is particularly suitable for latches incorporating a handle attached to a shaft. In particular, the present invention discloses a support means by which the shaft can be supported on the handle separate from the connection of the shaft to the handle. An example is illustrated in the figures of the present application comprising two projections extending from the shaft which are supported within a seating member on the handle member. This particular feature of the present invention is not only suited for the latch illustrated in the figures in which the shaft is integrally formed to the handle but also can be suitable for other latches as well, such as those incorporating a separate pin for connection of the shaft to the handle as well as those in which the shaft is either snap fit with or permanently attached to the handle member. The benefit in having a support for the shaft on the handle independent of the connection between the shaft and the handle is that at least a portion of the tension on the shaft occurring during operation is transferred from the point of connection between the handle member and shaft, which can increase the life of the device as a result of the reduction of stress at this particular point of the latch.

Another advantage of the present invention is that it discloses a retaining means for latches comprised of a handle member attached to a shaft whereby the positions of the handle member and the shaft relative to each other can be regulated. The retaining means feature of the present invention can have application not only for latches in which the shaft is integrally formed to the handle member, such as shown in the figures of the present invention, but also can be applicable to other types of latches as well, such as those incorporating a pin for attachment of the shaft to the handle member as well as those in which the shaft is snap-fit with or otherwise connected to the handle member. The present invention discloses two different arrangements for regulating the positions of the handle member and shaft; although it should be understood that it is not a requirement that both of these arrangements be provided in order to be considered within the scope and spirit of the present invention, however, this can be done where desired, such as to have a stronger retention between the handle member and shaft. One arrangement discloses that the retention is provided between the outer surface of the shaft and the seating member of the handle member; in particular, the outer portion of the shaft is snap-fit into inner surfaces of the seating member which terminate by opposing camming surfaces at spaced separation. The other arrangement for retention of the shaft relative to the handle member illustrated in the figures results from the interaction between the two projections extending from the shaft with the seating member; in particular, the two projections are snap-fit into the seating member by passing over camming surfaces extending from the seating member.

It should be recognized by those skilled in the art that changes may be made by the above-described embodiments of the invention without departing from the broad inventive concepts thereof. For example, while the present invention discloses an embodiment illustrating a swell latch assembly, it should be understood that the present invention can also have application with other types of latches as well, such as pawl latches for example. It is understood, therefore, that this invention is not limited to the particular embodiment disclosed, but it is intended to cover all modification which are within the scope and spirit of the invention as defined by the appended claims.

I claim:

1. A latch assembly for mounting in an aperture formed in a first member adapted for releasably retaining the first member against a corresponding second member and in a latched position, the latch assembly comprising:

a handle member adapted for pivotal rotation between a closed position and an open position;

a shaft integrally formed to the handle member providing a one-piece structure, wherein the shaft is adapted for movement in a generally axial direction corresponding with movement of said handle member between said open and said closed positions, with said shaft moving in a first direction when said handle member is moved from said open to said closed position and said shaft moving in a second direction substantially opposite said first direction when said handle member is moved from said closed position to said open position;

a latching member on said shaft for movement corresponding with movement of said shaft, wherein the latching member is adapted for releasably retaining the second member in engagement with the first member in the closed position of the handle member; and support means between said shaft and said handle member and independent of said integral connection between said shaft and said handle member for supporting said shaft by positioning a shaft portion against said handle member when said handle member is in said closed position and positioning said shaft portion at spaced separation from said handle member when said handle member is in said open position.

2. A latch assembly according to claim 1, wherein said support means comprises at least one projection extending from an outer surface of said shaft and a seating member on said handle member, wherein said seating member engages said at least one projection in said closed position of said handle member and is at spaced separation from said at least one projection in said open position of said handle member.

3. A latch assembly according to claim 2, wherein said at least one projection comprises first and second projections extending from opposite sides of said outer surface of said shaft and said seating member comprises first and second bosses at spaced separation extending from a surface of said handle member, with said first projection engaging said first boss and said second projection engaging said second boss.

4. A latch assembly according to claim 3, wherein said seating member further comprises means for retaining said shaft in a defined position by coupling of said shaft and said seating member.

5. A latch assembly according to claim 4, wherein said retaining means comprises said first and second bosses, with said first and second bosses being attached at first ends to said handle member and each of said first and second bosses including camming surfaces positioned proximate distal ends thereof, whereby said shaft and said handle member are snap-fit together by at least a portion of said shaft engaging and moving past said camming surfaces.

6. A latch assembly according to claim 5, wherein said two camming surfaces are positioned substantially opposing each other on inner surfaces of said two bosses and said at least a portion of said shaft comprises a portion of an outer surface of the shaft, wherein said spaced separation between said two bosses at said camming surfaces defines a gap smaller than a diameter of said portion of the outer surface of said shaft, whereby said portion of the outer surface shaft engages and flexes said camming surfaces from an original position to an extended position in order to allow said shaft to move past the camming surfaces and into said defined position, with said camming surfaces moving back toward said original positions when said shaft is in said defined position.

7. A latch assembly according to claim 5, wherein said two camming surfaces are positioned on upper surfaces of said two bosses, with each camming surface defining a substantially ramped forward surface and a locking surface, wherein said at least a portion of said shaft comprises said first and second projections which engage and move past said camming surfaces.

8. A latch assembly according to claim 5, wherein said latching member comprises a bushing member on said shaft.

9. A latch assembly according to claim 8, further comprising a retaining member on said shaft for movement corresponding with movement of said shaft and for retaining said bushing member on said shaft.

10. A latch assembly adapted for a first member and for latching a second member comprising:

a handle member adapted for pivotal rotation between a closed position and an open position;

a shaft connected to said handle member, said shaft having an outer surface and at least one projection extending from said outer surface of the shaft, wherein the shaft is adapted for movement at least in a generally axial direction corresponding with movement of said handle member between said open and closed positions, said shaft adapted for being under tension at least when said handle member is in said closed position;

the handle member further including means for engaging said at least one projection of said shaft when said handle member is in said closed position so that at least a portion of said tension upon said shaft is supported by said handle member, wherein said engaging means is at spaced separation from said at least one projection of said shaft when said handle member is in said open position; and a latching member on said shaft for movement corresponding with movement of said shaft.

11. A latch assembly according to claim 10, wherein said at least one projection comprises first and second projections extending from opposite sides of said outer surface of said shaft and said engaging means comprises first and second bosses at spaced separation extending from a surface of said handle member, with said first projection engaging said first boss and said second projection engaging said second boss.

12. A latch assembly according to claim 11, wherein said engagement of said first and second projections with said first and second bosses is independent of said connection of said shaft and said handle member.

13. A latch assembly according to claim 12, wherein said engaging means further comprises means for retaining said shaft in a defined position by coupling of said shaft.

14. A latch assembly according to claim 13, wherein said retaining means comprises said first and second bosses, with said first and second bosses being attached at first ends to said handle member and each of said first and second bosses including camming surfaces positioned proximate distal ends thereof, whereby said shaft and said handle member are snap-fit together by at least a portion of said shaft engaging and moving past said camming surfaces.

15. A latch assembly according to claim 14, wherein said two camming surfaces are positioned substantially opposing each other on inner surfaces of said two bosses and said at least a portion of said shaft comprises a portion of an outer surface of the shaft, wherein said spaced separation between said two bosses at said camming surfaces defines a gap smaller than a diameter of said portion of the outer surface of said shaft, whereby said portion of the outer surface shaft engages and flexes said camming surfaces from an original position to an extended position in order to allow said shaft to move past the camming surfaces and into said defined position, with said camming surfaces moving back toward said original positions when said shaft is in said defined position.

16. A latch assembly according to claim 14, wherein said two camming surfaces are positioned on upper surfaces of said two bosses, with each camming surface defining a substantially ramped forward surface and a locking surface, wherein said at least a portion of said shaft comprises said first and second projections which engage and move past said camming surfaces.

17. A latch assembly according to claim 14, wherein said latching member comprises a bushing member on said shaft.

18. A latch assembly according to claim 17 further comprising a retaining member on said shaft for movement corresponding with movement of said shaft and for retaining said bushing member on said shaft.

19. A latch assembly comprising:

a handle member adapted for pivotal rotation between a closed position and an open position;

a shaft connected to the handle member, wherein the shaft is adapted for movement in at least a generally axial direction corresponding with movement of said handle member between said open and closed positions, with said shaft moving in a first direction when said handle member is moved from said open position to said closed position and said shaft moving in a second direction substantially opposite said first direction when said handle member is moved from said closed position to said open position;

means between said shaft and said handle member for retaining said shaft in a defined position relative to said handle member when said handle member is in said closed position by engagement of a shaft portion and a portion of said handle member, wherein said shaft portion and said portion of said handle member are at spaced separation in said open position of said handle member; and a latching member on said shaft.

20. A latch assembly according to claim 19, wherein said retaining means comprises first and second bosses at spaced separation, with said first and second bosses being attached at first ends to said handle member and each of said first and second bosses including camming surfaces positioned proximate distal ends thereof, whereby at least a portion of said shaft is moved to engage and move past said camming surfaces.

21. A latch assembly according to claim 20, wherein said two camming surfaces are positioned substantially opposing each other on inner surfaces of said two bosses and said at least a portion of said shaft comprises a portion of an outer surface of the shaft, wherein said spaced separation between said two bosses at said camming surfaces defines a gap smaller than a diameter of said portion of the outer surface of said shaft, whereby said portion of the outer surface shaft engages and flexes said camming surfaces from an original position to an extended position in order to allow said shaft to move past the camming surfaces and into said defined position, with said camming surfaces moving back toward said original positions when said shaft is in said defined position.

22. A latch assembly according to claim 20, wherein said two camming surfaces are positioned on upper surfaces of said two bosses, with each camming surface defining a substantially ramped forward surface and a locking surface, wherein said at least a portion of said shaft comprises said first and second projections which engage and move past said camming surfaces.

23. A latch according to claim 20, wherein said shaft further comprises first and second projections extending from opposite sides of an outer surface of said shaft, with said first projection engaging said first boss and said second projection engaging said second boss.

24. A latch assembly according to claim 23, wherein said shaft is integrally formed to the handle member providing a one-piece structure.

25. A latch assembly according to claim 24, wherein said latching member comprises a bushing member on said shaft.

26. A latch assembly according to claim 25 further comprising a retaining member on said shaft for movement corresponding with movement of said shaft and for retaining said bushing member on said shaft.

27. A latch assembly according to claim 19 further comprising:

a retaining member with said shaft proximate said latching member; and means between said retaining member and said shaft for snap-fit attachment of said retaining member on said shaft.

28. A latch assembly according to claim 27, wherein said snap-fit attachment means comprises at least one substantially resilient tab and a captivation member for receiving said substantially resilient tab.

29. A latch assembly according to claim 28, wherein said retaining member comprises an outer surface, upper and lower surfaces, and a cavity within said upper surface defining a seating member, with said at least one substantially resilient tab attached with and extending from said seating member.

30. A latch assembly according to claim 29, wherein said shaft includes said captivation member, with said captivation member comprising a notch within said outer surface of said shaft for receiving said at least one substantially resilient tab, whereby said retaining member is snap-fit on said shaft by said second end of said shaft being received into said cavity within said retaining member, with said at least one substantially resilient tab first being flexed from an original position outward in a direction of said outer surface of said retaining member due to contact with said outer surface of said shaft, and then said at least one substantially resilient tab flexing back toward the original position when received into said notch within said outer surface of said shaft.

31. A latch assembly according to claim 30, wherein said snap-fit attachment means comprises a plurality of substantially resilient tabs attached with and extending from said seating member of said retaining member.

32. A latch assembly according to claim 31 further comprising means between said handle and said shaft for axial translation of said shaft on pivotal rotation of said handle, wherein said latching member comprises a bushing having an opening therethrough for being received on said shaft, with said bushing being compressed by axial translation of said retaining member through axial translation of said shaft when said handle is pivotally rotated to a closed position.

* * * * *